US011691047B2

(12) United States Patent
Wilson

(10) Patent No.: US 11,691,047 B2
(45) Date of Patent: Jul. 4, 2023

(54) TREADMILL SPEED CONTROL

(71) Applicant: Adam Wilson, Meadow Vista, CA (US)

(72) Inventor: Adam Wilson, Meadow Vista, CA (US)

( * ) Notice: Subject to any disclaimer, the term of this patent is extended or adjusted under 35 U.S.C. 154(b) by 308 days.

(21) Appl. No.: 17/065,771

(22) Filed: Oct. 8, 2020

(65) Prior Publication Data

US 2022/0111247 A1 Apr. 14, 2022

(51) Int. Cl.
*A63B 22/02* (2006.01)
*A63B 24/00* (2006.01)

(52) U.S. Cl.
CPC ..... *A63B 22/025* (2015.10); *A63B 24/0062* (2013.01); *A63B 2024/0093* (2013.01); *A63B 2220/05* (2013.01); *A63B 2220/805* (2013.01); *A63B 2220/807* (2013.01)

(58) Field of Classification Search
CPC ..... A63B 22/025; A63B 24/0062; A63B 71/0054; A63B 71/0622; A63B 24/0093; A63B 2071/0081; A63B 2071/0625; A63B 2071/0655; A63B 2220/05; A63B 2220/13; A63B 2220/30; A63B 2220/40; A63B 2220/805; A63B 2220/807; A63B 2225/02; A63B 2225/20; A63B 2225/50
See application file for complete search history.

(56) References Cited

U.S. PATENT DOCUMENTS 4,708,337 A 11/1987 Shyu
5,368,532 A 11/1994 Farnet
5,707,319 A 1/1998 Riley
7,101,319 B1 9/2006 Potts
8,343,016 B1 1/2013 Astilean
10,293,210 B2 5/2019 Wei et al.
10,420,982 B2 * 9/2019 Aragones ..... G09B 19/0038
10,953,281 B2 * 3/2021 Wei ..... A63B 24/0062
2009/0176629 A1 * 7/2009 Yi ..... A63B 22/025 482/54
2022/0072370 A1 * 3/2022 Kim ..... A63B 71/0622

OTHER PUBLICATIONS

"Camera calibration With OpenCV." OpenCV. Last Updated Dec. 31, 2019. Retrieved Oct. 6, 2020. Retrieved from the Internet: URL<https://docs.opencv.org/2.4/doc/tutorials/calib3d/camera_calibration/camera_calibration.html> . 11 pages.

(Continued)

*Primary Examiner* — Megan Anderson

(74) *Attorney, Agent, or Firm* — Fish & Richardson P.C.

(57) ABSTRACT

A speed control system and method for controlling the speed of an endless belt loop of a treadmill. The speed control system comprises a plurality of image sensors, each image sensor configured to take an image of a user of the treadmill; and a controller configured to control the speed of the endless belt loop by (a) receiving the images of the user taken by the image sensors, (b) rectifying the images based on a calibration of the image sensors, (c) comparing the images to form a disparity map, (d) determining a distance of a user of the treadmill relative to the treadmill using the disparity map, and (e) calculating velocity or acceleration of the treadmill based on the determined distance of the user.

15 Claims, 3 Drawing Sheets

(56) References Cited

OTHER PUBLICATIONS

Safford, Matt. "This New Treadmill automatically Adjusts to Your Speed." Smithsonian Magazine. Published Apr. 21, 2015. Retrieved Oct. 6, 2020. Retrieved from the Internet: URL<https://www.smithsonianmag.com/innovation/new-treadmill-automatically-adjusts-to-your-speed-180955058/>, 2 pages.

"What is Camera Calibration?" MATLAB & Simulink. Last updated Oct. 6, 2020. Retrieved Oct. 6, 2020. Retrieved from the Internet: URL<https://www.mathworks.com/help/vision/ug/camera-calibration.html>. 5 pages.

* cited by examiner

TREADMILL SPEED CONTROL

BACKGROUND

Treadmills include an endless powered belt loop supported on a frame such that an upper portion of the belt loop requires the user to run or walk at a predetermined pace based on the speed of the belt loop, which is driven by a drive motor. The speed of the belt loop can be selectively controlled and may vary at certain points during a particular program segment in order to permit the user to execute a number of different exercise programs.

The powering of the belt loop can create potential hazards in that the user is required to keep up with the pace set by the speed of the belt. If the user, for example, loses balance or is suddenly unable to walk or run in some way, the belt motion can cause the user to fall off the treadmill, perhaps causing injury.

Current treadmill controls require a user to manually adjust the speed of the belt loop using hand operated buttons. Treadmills that do not require manual user input to control the speed of the belt generally come in two varieties, powered and unpowered. The unpowered treadmills, an example of which is shown in U.S. Pat. No. 8,343,016, use the user's provided force to move the surface. This process requires coordination and athletic ability only capable by high-level athletes, and even then, can be a long and awkward learning experience. Powered automatic speed-controlled treadmills generally use a motor drive surface controlled by some aspect of the user's position. Most technology in this area use sensors that include error because of the user's clothing, material, color, as well as ambient light, leading to an inconsistent running or walking experience.

SUMMARY

In general, one aspect of the subject matter described in this specification is embodied in systems that include a speed control system for controlling the speed of an endless belt loop of a treadmill that includes a plurality of image sensors. Each image sensor is configured to take an image of a user of the treadmill. The system includes a controller configured to control the speed of the endless belt loop by (a) receiving the images of the user taken by the image sensors, (b) rectifying the images based on a calibration of the image sensors, (c) comparing the images to form a disparity map, (d) determining a distance of a user of the treadmill relative to the treadmill using the disparity map, and (e) calculating velocity or acceleration of the treadmill based on the determined distance of the user. The plurality of image sensors include one of a natural light, ultraviolet, or infra-red camera. The controller is configured to control the speed of the endless belt loop by calculating velocity or acceleration of the treadmill based on the determined distance of the user of the treadmill relative to a substantially-centered position of the user on the endless belt loop. In another aspect, the controller is configured to stop movement of the endless belt loop when the distance of the user relative to the treadmill surpasses a threshold value. In another aspect, the plurality of image sensors are communicatively coupled to the controller via one or more of wired, Bluetooth, or radio frequency.

In general, one aspect of the subject matter described in this specification is embodied in a treadmill including a platform, an endless belt loop supported on the platform so as to have an upper belt portion on which a user can stride, a plurality of image sensors, each image sensor configured to take an image of a user of the treadmill, and a speed control system. The speed control system being configured to control the speed of the endless belt loop by (a) receiving the images of the user taken by the image sensors, (b) rectifying the images based on a calibration of the image sensors, (c) comparing the images to form a disparity map, (d) determining a distance of a user of the treadmill relative to the treadmill using the disparity map, and (e) calculating one or more control signals based on the determined distance of the user. In one aspect, the plurality of image sensors are mounted on the treadmill. The treadmill includes a display, and the image sensors are mounted on an underside of the display. In other aspect, the plurality of image sensors comprises one of a natural light, ultraviolet, or infra-red camera. In another aspect, the speed control system is configured to control the speed of the endless belt loop by calculating one or more control signals indicating a velocity or acceleration of the treadmill based on the determined distance of the user of the treadmill relative to a substantially-centered position of the user on the upper portion of the endless belt loop.

In general, one aspect of the subject matter described in this specification is embodied in a method for controlling the speed of an endless belt loop of a treadmill including receiving images of a user of the treadmill taken by a pair of image sensors, rectifying the images based on a calibration of the image sensors, comparing the images to form a disparity map, determining a distance of a user of the treadmill relative to the treadmill using the disparity map, and calculating a velocity or acceleration of the treadmill based on the determined distance of the user. The method includes providing the calculated velocity or acceleration to a motor used to drive the endless belt loop. The method includes stopping movement of the endless belt loop when the distance of the user relative to the treadmill surpasses a threshold value.

In general, one aspect of the subject matter described in this specification is embodied in a non-transitory computer storage medium encoded with instructions that, when executed by one or more computers, cause the one or more computers to perform the method as described above.

In general, one aspect of the subject matter described in this specification is embodied in a system comprising one or more computers and one or more storage devices on which are stored instructions that are operable, when executed by the one or more computers, to cause the one or more computers to perform the method as described above.

Other implementations of this aspect include corresponding computer systems, apparatus, computer program products, and computer programs recorded on one or more computer storage devices, each configured to perform the actions of the methods. A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

The foregoing and other implementations can each optionally include one or more of the following features, alone or in combination.

The subject matter described in this specification relates to an exercise device with an endless motorized belt loop (e.g., treadmill) with the ability to automatically adjust the surface speed based on a user's position relative to the exercise device. There are a number of advantages of the currently-described device relative to the current state of the art. For example, current systems require a user to manually adjust the speed of the belt loop using hand-operated buttons. This type of arrangement can be difficult and dangerous when moving at a high speed. In addition, many sport runners desire the ability to pace themselves when outdoor running becomes unavailable. Such pacing is not available on current treadmill technology. In addition, users who have disabilities or are overweight may also have trouble moving at a constant speed for any length of time, thus making conventional treadmill technology a tedious process with manual speed controls. The addition of distance measurements allows for redundancy in emergency stop conditions. Current treadmills only have a mechanical emergency stop with no backup.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
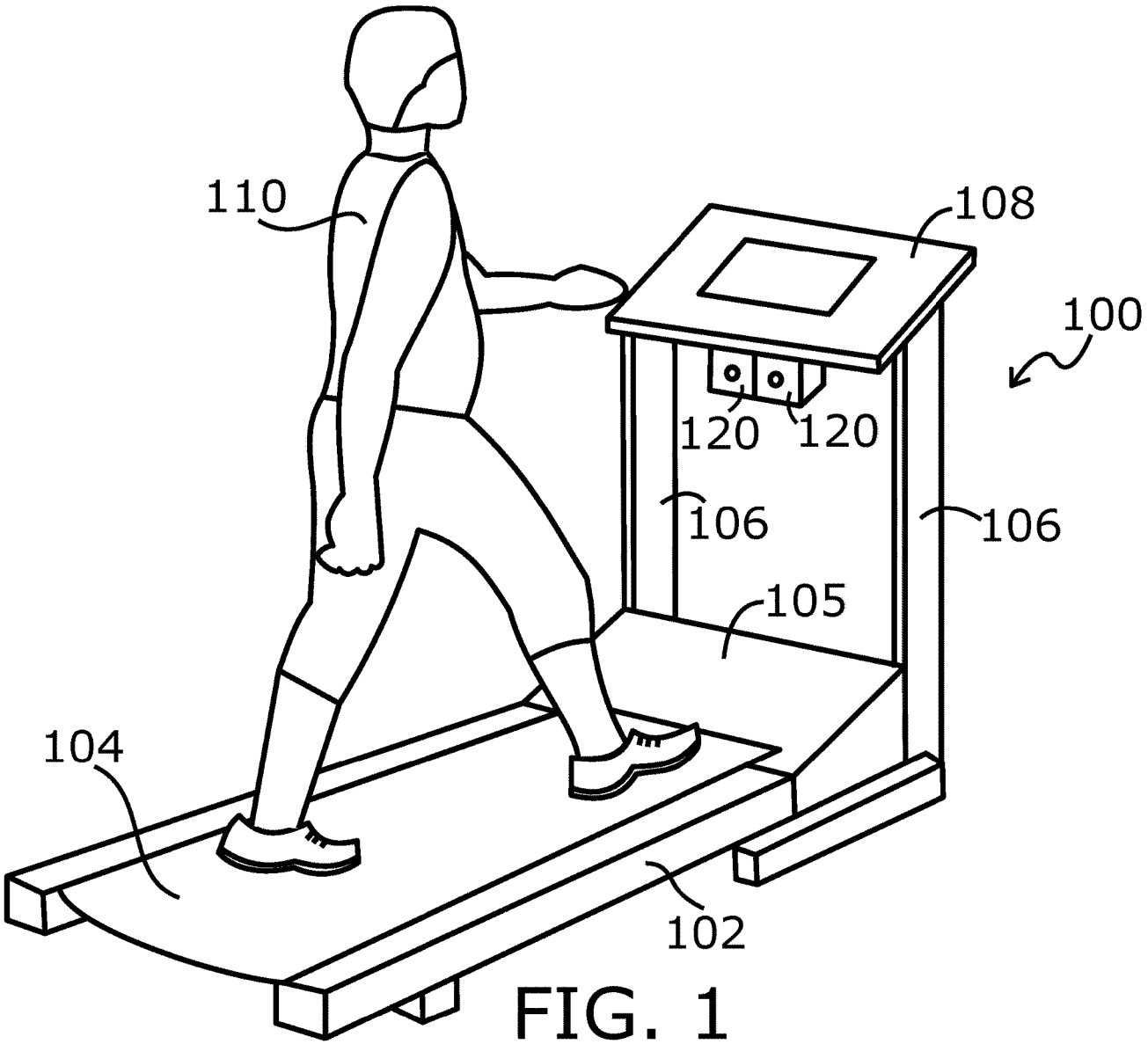
FIG. 1 is a perspective view of a treadmill device equipped with a user-position speed control arrangement.

FIG. 1 depicts an example treadmill device 100. The treadmill 100 includes a generally rectangular platform 102 on which is mounted an endless belt loop 104. The endless belt loop 104 is configured to be driven or recirculated by a drive motor (not shown) disposed under a motor cover 105 in a conventional manner. The motor can comprise a brushed or brushless DC motor. A pair of upright frame members 106 are located on a respective side of the platform 102. The frame members 106 support a control panel 108 which allows a user 110 to select from a number of different operating parameters, such as speed, platform inclination, activity program, or other known operating variables. The control panel 108 can comprise an interface touchscreen display or other suitable display technology.

As shown in FIG. 1, a pair of image sensors 120 are mounted to an underside of the control panel 108. These image sensors 120 can be mounted to the treadmill at any suitable location, such as the underside of the control panel 108 (as shown in FIG. 1), at an upper surface or edge of the control panel 108, at locations along either of the upright frame members 106, or at a location on the motor cover 105. It should also be understood that the image sensors 120 do not have to be mounted on any portion of the treadmill. For example, the image sensors 120 can be mounted on respective stands, tripods, or other stand-alone type mounting structures. In the implementation shown in FIG. 1, the image sensors 120 are mounted on the treadmill 100 facing the user of the treadmill such that the image sensors 120 capture an image around the waist area of the user 110. In alternative implementations, the image sensors 120 could be mounted such that the sensors capture image(s) of other parts of the user, such as the user's chest, legs, midsection, etc.

The image sensors 120 can comprise any number of suitable image capturing devices, such as natural light, ultraviolet, infra-red, or other suitable cameras used for capturing images. In addition, the image sensors 120 can be operatively coupled to the treadmill 100, and more particularly, communicatively coupled to the control system of the treadmill 100 by any suitable communications methodology, including, but not limited to, wired, Bluetooth, radio frequency, or other suitable communication method.

Figure 2:
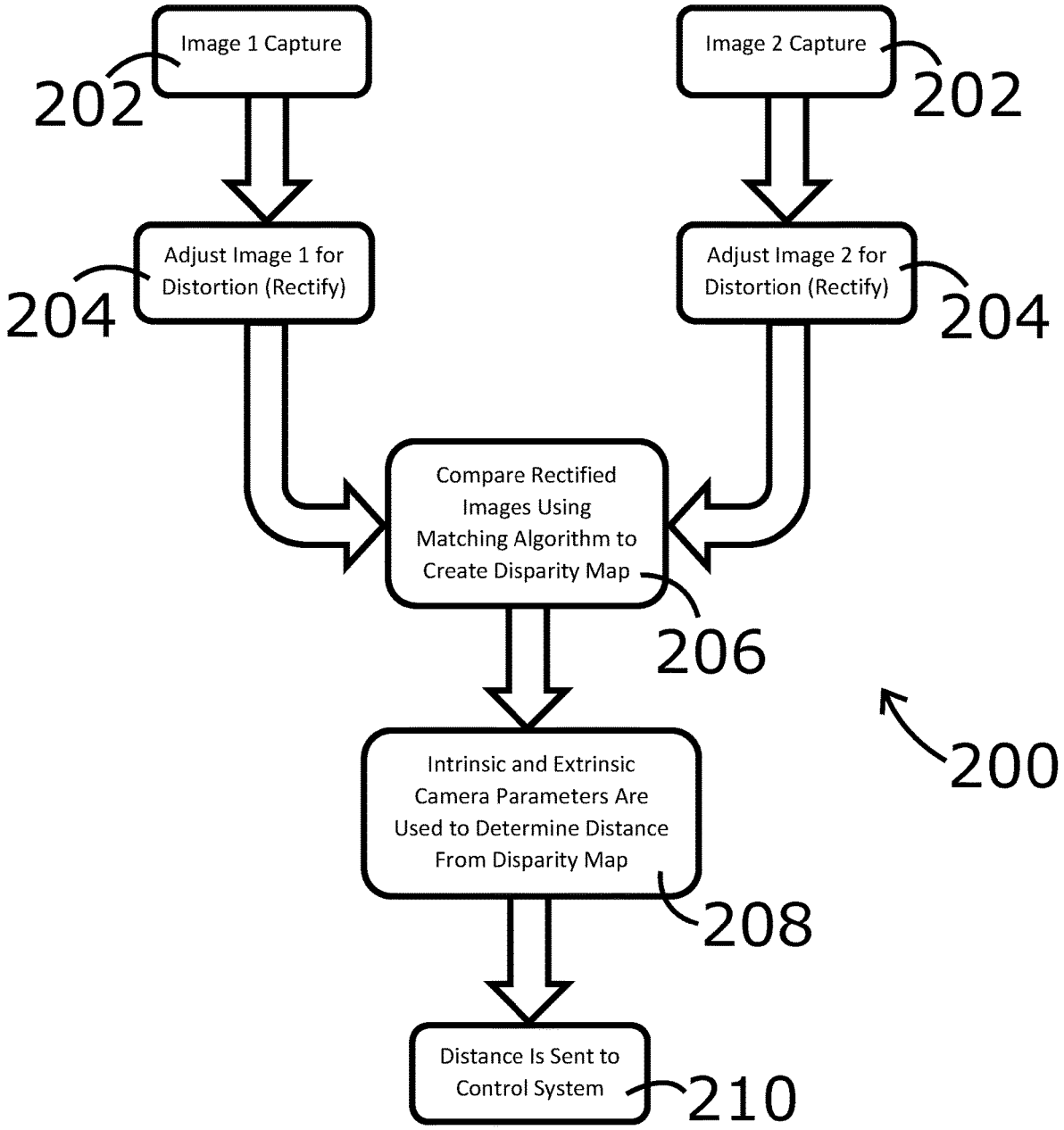
FIG. 2 is a flow diagram of a process for capturing images of a user of a treadmill device and determining a distance of the user relative to the treadmill device and providing that information to a control circuit to control a speed of the treadmill device.

Referring to FIG. 2, a flow diagram depicting a process 200 for capturing images of a user and determining a distance of the user relative to the treadmill and providing that information to a control circuit to control a speed of the treadmill is illustrated. At step 202, images of a user of the treadmill are captured by a pair of image sensors, such as image sensors 120 of FIG. 1. Each image sensor 120 takes an image of the user (for example, the user's waist area) at substantially the same time (e.g., within a portion of a second to each other). The two images are then adjusted at step 204 for distortion in a process sometimes referred to as rectifying or rectification. The adjustment step 204 is performed based on a previous calibration to account for image distortion caused by, for example, the lenses of the image sensors. A number of any different, suitable calibration methods can be employed in the present system.

For example, a camera generally has two properties, the intrinsic properties (internal image distortion), and the extrinsic properties (camera rotation and translation). The first step is finding each camera's intrinsic properties. Image distortion can be tangential and radial. The parameters of the distortions are represented in, for example, a 4×3 camera matrix. The goal of intrinsic camera calibration is to determine the camera matrix for each individual sensor and lens combination. Camera calibration is generally accomplished by first taking many images of patterns of known shapes and sizes. Because the actual shapes and sizes are known, the parameters that achieve the least distorted image can be chosen for each image. All estimated parameters are then compared to achieve a more accurate estimation of the camera intrinsic parameters. Each camera has unique intrinsic parameters.

For extrinsic parameter estimation, both cameras generally first need to be held stationary with respect to each other. One camera is set as the origin with zero translation and rotation. Both cameras then take images of the same pattern at relatively the same time. The images are then undistorted using the intrinsic parameters of each camera. The second camera's extrinsic parameters are then set to align the second image to the first image in both rotation and vertical position (creating aligning epipolar lines). The images generally are not aligned horizontally as the horizontal translation from one image to the other is what is used to determine distance. (Generally, it is understood that regardless of the two cameras' orientation in space, they are considered side by side with respect to each other.) Extrinsic parameters are generally maintained during use as long as the cameras are held substantially stationary with respect to each other.

The process of using the determined camera model (intrinsic and extrinsic parameters) to undistort and translate the captured images is sometimes referred to as rectification.

This calibration generally needs to occur once after assembly and again if, for example, the cameras or image sensors 120 are shifted with respect to each other or if the camera or image sensor internals are shifted changing the image sensor parameters.

Following the adjustment step 204, the adjusted/rectified images are then employed in a matching algorithm to create what is referred to as a disparity map (a map that shows the pixel distance of the shift between two images) at step 206. The disparity map can be used to determine the distance of the user of the treadmill relative to the treadmill, or relative, for example, to a predetermined position on an upper portion of the endless belt loop. Any suitable process for creating a disparity map may be employed without departing from the spirit of this disclosure. As one example, to determine real world distance, the image sensor capture images relatively or substantially at the same time. The captured images are then rectified and compared by choosing an area on the first image and then finding that same area on the second image. This process is repeated for the entire image frame. This creates a map of pixel distances, which is directly related to real world distance based on the focal distances and distance between the two cameras (baseline). To find the transformation from pixel distance to real world distance, objects are measured at many known distances, which are then related back to the calculated pixel distance. The found model then can be used to estimate the world distance relatively accurately. This process generally needs to happen once at the end of assembly and if the image sensors 120 are shifted with respect to each other or the camera intervals are shifted, changing the camera parameters.

Figure 3:
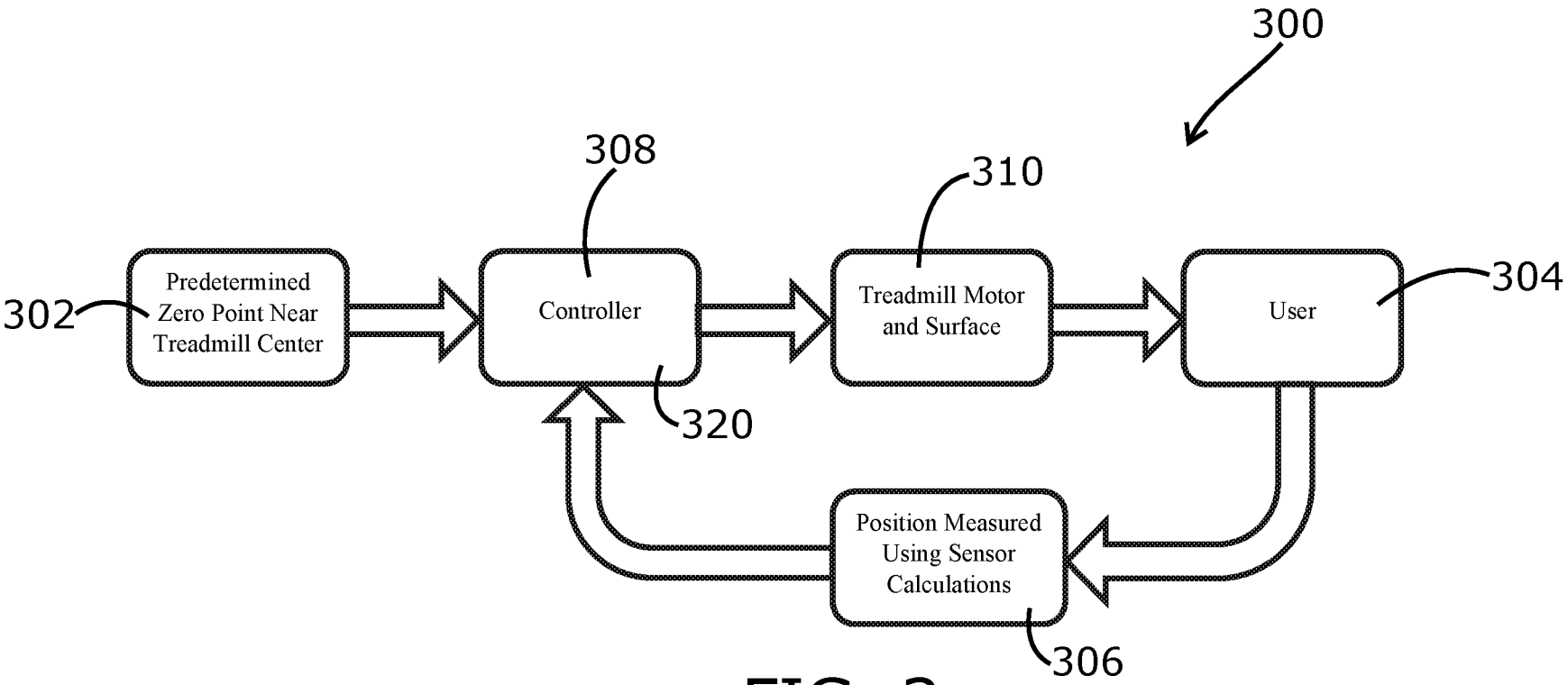
FIG. 3 is a flow diagram depicting the control loop employed in controlling the speed of the treadmill device based on a position of the user relative to the treadmill device.

At step 208, the intrinsic parameters (focal length of both cameras) and extrinsic parameters (distance between the two cameras) found during the calibration are used to calculate the distance from the disparity map created in step 206. The distance calculated, for example, using the disparity map of step 206, can then be sent to a control circuit at step 210, such as a controller 320 of a control system (FIG. 3). The controller 320 calculates parameters, such as velocity or acceleration, or both, needed to maintain the user on a relatively centered position on the upper portion of the endless belt loop of the treadmill. Those skilled in the art should be familiar with the use of controllers in processing environments generally and controllers may be implemented in software, firmware, hardware or some suitable combination of at least two of the three. The controller 320 can also create an emergency stop condition in which the moving endless belt loop is stopped when the user's position falls too far forward or backward relative to the treadmill or to a reference point or area on the upper surface of the endless belt loop, or when the distance of the user relative to the treadmill surpasses a particular threshold value (such as a distance from the treadmill or from a reference point or area on the upper surface of the endless belt loop). Such a threshold value could be, for example, 3 inches, 6 inches, 12 inches, or more or less.

Referring to FIG. 3, there is shown a flow diagram depicting a control loop 300 employed by a control system in controlling the speed of the treadmill based on a position of the user relative to the treadmill. At step 302, the system provides a predetermined zero point or area near the center of the treadmill to the controller 320. This point is the general location relative to the treadmill that a user will try to maintain during use of the treadmill. Venturing too far away from this central location during use may present certain safety considerations to the user, such as falling off the treadmill belt, or coming into contact with the front portion of the treadmill, which could cause the user to lose balance and sustain an injury. The purpose of the zero point is to determine whether the belt needs to slow down (user behind zero point) or speed up (user in front of zero point). At step 304, the image sensors 120 capture the images of the user, for example, the user's waist area, and the user's position is measured using the image sensor calculations at step 306, as described above with reference to FIG. 2 and its description. As noted above, the position of the user is then fed to the controller 320, which can include one or more processors, at step 308. The controller 320 calculates the parameters, such as velocity and/or acceleration, and sends that information to the treadmill motor controlling the endless loop belt surface at step 310 in order to increase or decrease the speed of the endless belt loop in an attempt to maintain the user's location within or near the zero or central location of the treadmill.

Embodiments of the subject matter and the functional operations described in this specification can be implemented in digital electronic circuitry, in tangibly-embodied computer software or firmware, in computer hardware, including the structures disclosed in this specification and their structural equivalents, or in combinations of one or more of them. Embodiments of the subject matter described in this specification can be implemented as one or more computer programs, i.e., one or more modules of computer program instructions encoded on a tangible non-transitory program carrier for execution by, or to control the operation of, data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. The computer storage medium can be a machine-readable storage device, a machine-readable storage substrate, a random or serial access memory device, or a combination of one or more of them.

The term "data processing apparatus" refers to data processing hardware and encompasses all kinds of apparatus, devices, and machines for processing data, including by way of example a programmable processor, a computer, or multiple processors or computers. The apparatus can also be or further include special purpose logic circuitry, e.g., an FPGA (field programmable gate array) or an ASIC (application-specific integrated circuit). The apparatus can optionally include, in addition to hardware, code that creates an execution environment for computer programs, e.g., code that constitutes processor firmware, a protocol stack, a database management system, an operating system, or a combination of one or more of them.

A computer program, which may also be referred to or described as a program, software, a software application, a module, a software module, a script, or code, can be written in any form of programming language, including compiled or interpreted languages, or declarative or procedural languages, and it can be deployed in any form, including as a stand-alone program or as a module, component, subroutine, or other unit suitable for use in a computing environment. A computer program may, but need not, correspond to a file in a file system. A program can be stored in a portion of a file that holds other programs or data, e.g., one or more scripts stored in a markup language document, in a single file dedicated to the program in question, or in multiple coordinated files, e.g., files that store one or more modules, sub-programs, or portions of code. A computer program can be deployed to be executed on one computer or on multiple computers that are located at one site or distributed across multiple sites and interconnected by a communication network.

The processes and logic flows described in this specification can be performed by one or more programmable computers executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

Computers suitable for the execution of a computer program include, by way of example, general or special purpose microprocessors or both, or any other kind of central processing unit. Generally, a central processing unit will receive instructions and data from a read-only memory or a random access memory or both. The essential elements of a computer are a central processing unit for performing or executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a smart phone, a personal digital assistant (PDA), a mobile audio or video player, a game console, a Global Positioning System (GPS) receiver, or a portable storage device, e.g., a universal serial bus (USB) flash drive, to name just a few.

Computer-readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, embodiments of the subject matter described in this specification can be implemented on a computer having a display device, e.g., LCD (liquid crystal display), OLED (organic light emitting diode) or other monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's device in response to requests received from the web browser.

Embodiments of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network (LAN) and a wide area network (WAN), e.g., the Internet.

The computing system can include clients and servers. A client and server are generally remote from each other and typically interact through a communication network. The relationship of client and server arises by virtue of computer programs running on the respective computers and having a client-server relationship to each other. In some embodiments, a server transmits data, e.g., an Hypertext Markup Language (HTML) page, to a user device, e.g., for purposes of displaying data to and receiving user input from a user interacting with the user device, which acts as a client. Data generated at the user device, e.g., a result of the user interaction, can be received from the user device at the server.

While this specification contains many specific implementation details, these should not be construed as limitations on the scope of what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described above should not be understood as requiring such separation in all embodiments, and it should be understood that the described program components and systems can generally be integrated together in a single software product or packaged into multiple software products.

Particular embodiments of the invention have been described. Other embodiments are within the scope of the following claims. For example, the steps recited in the claims, described in the specification, or depicted in the figures can be performed in a different order and still achieve desirable results. In some cases, multitasking and parallel processing may be advantageous.

What is claimed is:

1. A speed control system for controlling a speed of an endless belt loop of a treadmill, the speed control system comprising:

a plurality of image sensors, each of the plurality of image sensors configured to take an image of a user of the treadmill; and a controller configured to control the speed of the endless belt loop by (a) receiving the images of the user taken by the plurality of image sensors, (b) rectifying the images based on a calibration of the plurality of image sensors, (c) comparing the images to form a disparity map, (d) determining a distance of the user of the treadmill relative to the treadmill using the disparity map, and (e) calculating velocity or acceleration of the treadmill based on the determined distance of the user.

2. The system of claim 1, wherein the plurality of image sensors comprises one of a natural light, ultraviolet, or infra-red camera.

3. The system of claim 1, wherein the controller is configured to control the speed of the endless belt loop by calculating velocity or acceleration of the treadmill based on the determined distance of the user of the treadmill relative to a centered position of the user on the endless belt loop.

4. The system of claim 1, where the controller is configured to stop movement of the endless belt loop when the distance of the user relative to the treadmill surpasses a threshold value.

5. The system of claim 1, wherein the plurality of image sensors are communicatively coupled to the controller via one or more of wired, Bluetooth, or radio frequency.

6. A treadmill comprising:

a platform;

an endless belt loop supported on the platform so as to have an upper belt portion on which a user can stride;

a plurality of image sensors, each of the plurality of image sensors configured to take an image of the user of the treadmill; and a speed control system configured to control the speed of the endless belt loop by (a) receiving the images of the user taken by the plurality of image sensors, (b) rectifying the images based on a calibration of the plurality of image sensors, (c) comparing the images to form a disparity map, (d) determining a distance of the user of the treadmill relative to the treadmill using the disparity map, and (e) calculating one or more control signals based on the determined distance of the user.

7. The treadmill of claim 6, wherein the plurality of image sensors are mounted on the treadmill.

8. The treadmill of claim 6, wherein the treadmill comprises a display, and wherein the plurality of image sensors are mounted on an underside of the display.

9. The treadmill of claim 6, wherein the plurality of image sensors comprises one of a natural light, ultraviolet, or infra-red camera.

10. The treadmill of claim 6, wherein the speed control system is configured to control the speed of the endless belt loop by calculating one or more control signals indicating a velocity or acceleration of the treadmill based on the determined distance of the user of the treadmill relative to a centered position of the user on the upper portion of the endless belt loop.

11. A method for controlling the speed of an endless belt loop of a treadmill comprising:

receiving images of a user of the treadmill taken by a pair of image sensors;

rectifying the images based on a calibration of the pair of image sensors;

comparing the images to form a disparity map determining a distance of the user of the treadmill relative to the treadmill using the disparity map; and calculating a velocity or acceleration of the treadmill based on the determined distance of the user.

12. The method of claim 11, comprising:

providing the calculated velocity or acceleration to a motor used to drive the endless belt loop.

13. The method of claim 11, comprising:

stopping movement of the endless belt loop when the distance of the user relative to the treadmill surpasses a threshold value.

14. A non-transitory computer storage medium encoded with instructions that, when executed by one or more computers, cause the one or more computers to perform the method of any of claims 11 to 13.

15. A system comprising one or more computers and one or more storage devices on which are stored instructions that are operable, when executed by the one or more computers, to cause the one or more computers to perform the method of any of claims 11 to 13.

* * * * *